United States Patent [19]

Shane

[11] 4,174,862

[45] Nov. 20, 1979

[54] DOOR FRAME PROTECTOR

[76] Inventor: Charles F. Shane, 3003 Mountain View Ave., Renton, Wash. 98055

[21] Appl. No.: 765,838

[22] Filed: Feb. 4, 1977

[51] Int. Cl.[2] ..... E05C 21/00

[52] U.S. Cl. ..... 292/346; 292/340

[58] Field of Search ..... 292/340, 346; 52/514; 49/394, 462

[56] References Cited

U.S. PATENT DOCUMENTS

| | | | |
|---|---|---|---|
| 1,377,458 | 5/1921 | Block | 292/346 X |
| 2,726,112 | 12/1955 | Conhogen | 292/340 X |
| 3,764,173 | 10/1973 | Griffith | 292/346 |
| 3,888,530 | 6/1975 | Fabrici | 292/346 |
| 3,918,207 | 11/1975 | Aliotta | 52/514 X |
| 3,963,269 | 6/1976 | Rosenberg | 292/346 |
| 4,005,890 | 2/1977 | Murch | 292/346 |

*Primary Examiner*—Richard E. Moore
*Attorney, Agent, or Firm*—Dowrey & Cross

[57] ABSTRACT

The protector includes a generally U-shaped main body portion engageable with the major circumference of one or more door frame support members. A perpendicular flange portion projects from one terminal portion of the main body portion for engagement with a portion of the door frame which will be subjected to splitting forces during an attempt at forcible entry. A coplanar extension of the other terminal portion of the main body portion forms an anchor. The protector thus can serve as a combination anchor-door frame protector, or as a door frame protector alone. In the latter instance, the extension and adjacent segment of the main body portion may be eliminated.

6 Claims, 4 Drawing Figures

FIG. 1
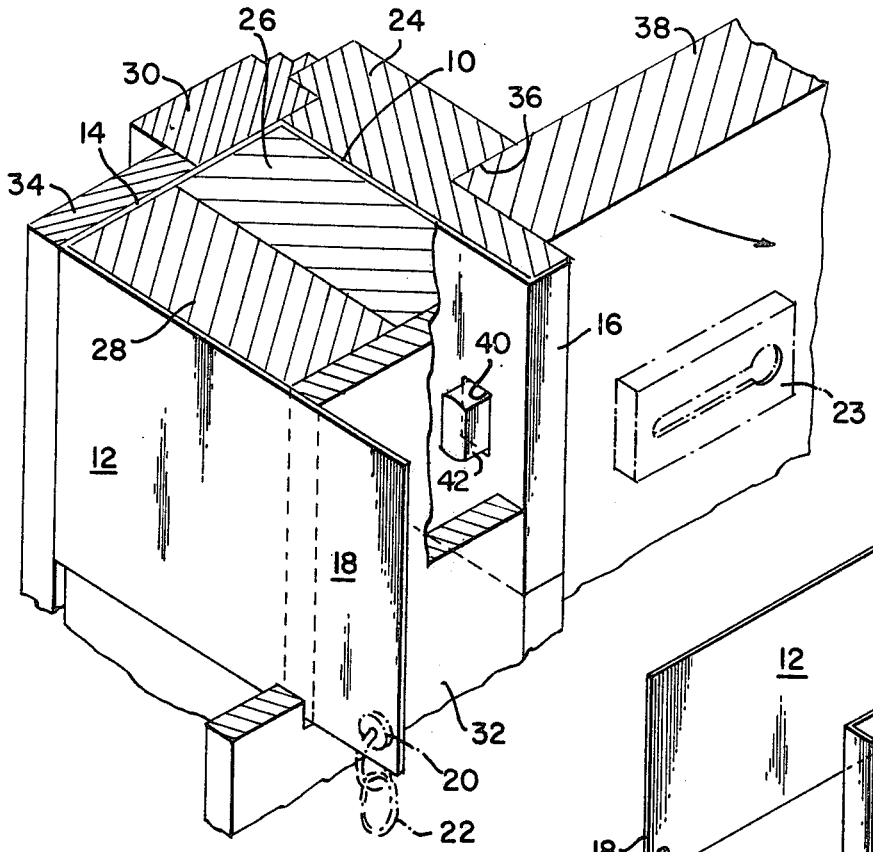
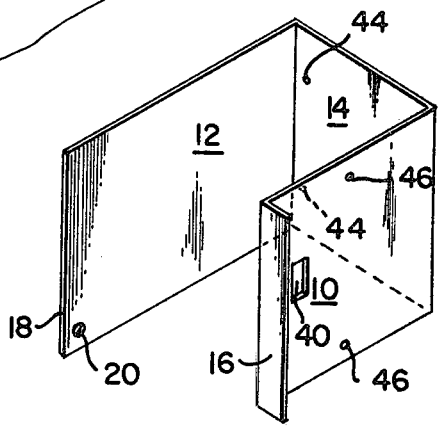
FIG. 2
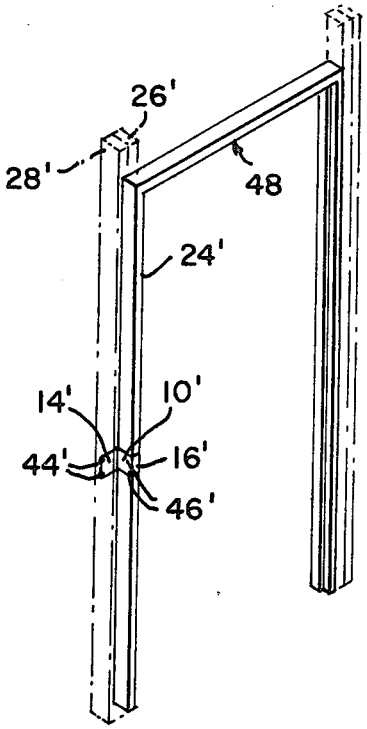
FIG. 4
FIG. 3
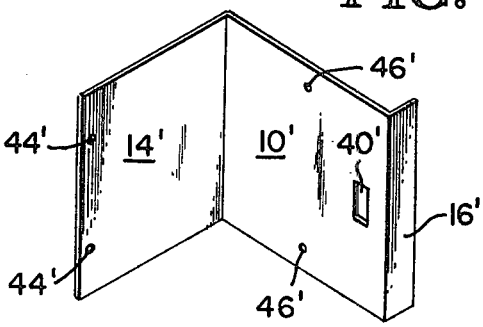

DOOR FRAME PROTECTOR

BACKGROUND OF THE INVENTION

This invention relates to door security devices and, more particularly, to door frame protectors.

Prior door frame protectors typically reinforce the door frame adjacent the strike plate and/or bolt receiving recess in order to prevent splitting of the door frame by a force applied at the bolt receiving recess during an attempt to forcibly open the door. Such reinforcement commonly is accomplished merely by strengthening and/or enlarging the conventional strike plate and associated mounting structure so that it covers or is secured to all or a portion of the door frame width adjacent the bolt recess, or overlaps portions of the adjacent wall or support members, or both. Examples of prior door frame protectors of this type are disclosed in U.S. Pat. Nos. 3,888,530; 3,855,746; 3,764,173; 3,345,780; and 1,995,764. These door frame protectors, while offering certain reinforcement, tend to be unsightly, often are difficult to install properly, lack versatility, and generally are unecommical for mass production fabrication and installation application. Another drawback of these and other door frame protectors is that, when additional anchored security devices such as chains are desired, these must be secured separate to the frame at a location spaced from the strike plate. The anchored security devices make the door even more unsightly and further weaken the door frame to splitting during a forcible entry.

The door frame protector disclosed in U.S. Pat. No. 3,918,207 may be used with conventionally sized strike plates but, in many practical applications, tends to provide insufficient splitting resistance because splitting stresses are merely distributed along the inner face of the door frame or jamb by the L-shaped plate secured thereto.

SUMMARY OF THE INVENTION

This invention overcomes or substantially mitigates these and other problems of prior door frame protectors by providing a door frame protector, or combination anchor-door frame protector, which transmits a splitting force from the door frame or jamb portion, which will be subjected to such a force during an attempt to force the door open, to a door frame support member or wall stud. The force is transmitted along a path which extends between the door frame and support member, and preferably begins and ends at transversely spaced apart parallel faces of the door frame and support member, respectively. In most practical cases, the aforementioned door frame and support member faces respectively coincide with the inner and outer faces of the door opening, or underlie the inner and outer wall coverings. The meanings of the terms "inner" and "outer" as used herein may be understood by refering to the direction in which the door opens and closes—the "inner" wall or door frame surfaces facing in the direction in which the door opens, and the "outer" wall or door frame surfaces facing in the direction of door closure.

According to one preferred embodiment of the invention, the combination anchor-door frame protector is comprised of a plate-like member which includes a main body portion so constructed and arranged that it may be engaged with a major portion of the circumference if a door frame support member with two terminal portions of the main body portion spaced apart and adjacent the remaining portion of the door frame support member circumference. A flange projects perpendicularly from one terminal portion of the main body portion for engagement with one face of the door frame which will be subjected to splitting forces during an attempt to force the door open. A coplanar extension of the other terminal portion of the main body portion forms an anchor. The main body preferably is generally U-shaped.

Thus it will be appreciated from the foregoing summary that this invention provides a highly effective door frame protector which prevents or substantially minimizes splitting of the door frame during a forcible entry by transmitting splitting forces from the door frame to a support member. Splitting forces thus may be transmitted from the portion of the door frame or jamb adjacent the bolt receiving recess (the portion of the door frame most likely to split during a forcible entry) to a relatively stronger support member, such as a wall stud or studs, to which such forces are applied compressively (preferably at the outside edge face thereof). The protector, however, extends internally of the wall—between the door frame and support member—and hence does not create an adverse effect upon the door's appearance. One preferred protector construction further affords an anchor, thereby eliminating the need for separate anchors in the event supplemental security devices are desired. This construction also is highly versatile because it can be fitted to conventional building studs by appropriate selection of the main body portion construction and, in some applications, can serve as a template for mounting the jamb itself. In applications in which an anchor is not desired, the main body portion can be modified by deleting the anchor portion, leaving oppositely projecting flanges for engaging the support member and door frame, respectively. In this instance, the protector can be used as a template in a new and highly effective technique for mounting a jamb or even a pre-hung door. Both constructious additionally can serve as positive stops for a dead bolt.

These and other features, objects and advantages of the invention will become apparent in the detailed description and claims to follow taken in conjunction with the accompanying drawings in which like parts bear like reference numerals.

BRIEF DESCRIPTION OF THE DRAWINGS

FIG. 1 is a perspective view of a door and door frame, partially in section, equipped with the door frame protector of this invention;

FIG. 2 is a perspective view of the FIG. 1 protector;

FIG. 3 is a perspective view of a modified form of the FIG. 1 protector;

FIG. 4 is a perspective view of a door frame depicting use of the FIG. 3 protector to mount a pre-hung door.

DETAILED DESCRIPTION OF THE DRAWINGS

Referring first to FIG. 2 of the drawings, the door frame protector of this invention is comprised of a generally U-shaped main body portion which includes two spaced apart parallel plate portions 10 and 12, and a perpendicular flange portion 14 extending between adjacent edges of portions 10, 12 as shown (FIG. 2). A flange portion 16 projects oppositely from the other edge of portion 10 in parallel relation with portion 14 and perpendicular to portion 10 as shown (FIG. 2). An extension portion 18 projects from portion 12 in coplanar relation therewith and forms an appropriate anchor 20 for a suitable supplemental sucurity device 22—in illustrated example the anchor is constituted by an opening through which extends the end link of a chain engageable with a door mounted slide 23 (FIG. 1). The FIG. 2 protector is composed of appropriate metallic or synthetic plate-like material.

An example of one door frame construction with which the door frame protector of this invention may be used is illustrated in FIG. 1 of the drawings. As will be appreciated, the protector may be used with other door frame constructions. The FIG. 1 example is therefore not considered as limiting.

The FIG. 1 door frame construction is of conventional design and includes a frame member 24; two supporting members 26, 28; outer trim member 30; and opposed inner and outer wall coverings 32, 34. The member 24 includes a square sholder 36 for engaging and positioning the door 38 at the closed position thereof. In the illustrated construction, the door 38 swings open in the direction indicated by the arrow.

In the illustrated example of FIG. 1, the protector should be positioned with portion 16 in face-to-face engagement with the inner edge face of frame 24, and portion 14 in face-to-face engagement with the outer edge faces of members 26, 28 as shown (FIG. 1). Portion 10 intervenes between and interfaces with opposed transverse side faces of members 24 and 26, as shown (FIG. 1).

For provision of a combination anchor-door frame protector, the main body of the protector engages a major portion of the circumference of members 26, 28 (or of a single support member of identical cross-sectional configuration) with portions 16 and 18 spaced apart and adjacent the remaining support member circumference, or adjacent inner wall covering 32, as shown (FIG. 1). Portions 14 and 18 are of lengths sufficient to provide an anchor point at desired spacing from the door. As will be appreciated by referring to FIG. 1, only portions 16 and 18 are visible from the inside, all other portions of the protector being cancealed by the illustrated frame construction.

As a positive stop for a strong bolt or dead bolt, the protector additionally may include a suitable opening 40 in portion 10. This opening should have an outline which registers with a conventional dead bolt 42 in order to be engageable therewith as depicted in FIG. 1.

In the illustrated example of FIG. 1, the door frame portector should be mounted adjacent the strike plate and bolt recess (not shown), and should extend above and below the strike plate and bolt recess to provide adequate force bearing therefore. In the event of an attempted forcible entry, splitting forces applied by the bolt to the frame members 24 at the bolt recess appear at the inner edge face of member 24. Portion 16 receives these forces and transmits them via portion 10 to portion 14. Portion 14 thereupon applies these forces compressively over the outer edge faces of members 26 and 28.

To mount the protector of FIGS. 1 and 2, the main body portion is fitted about the adjacent structural member or members, as shown (FIG. 1). In the particular door construction illustrated, members 26 and 28 are conventional building studs. In this and similar cases, therefore, the protector can serve as a template for mounting this frame, member 24, or a pre-hung door assembly made up of completed frame and hinge mounted door, provided, of course, that the studs are plumb. To this end, the protector first is secured to the stud 28 by nails (not shown) which extend through holes 44 (FIG. 2) in portion 14. Next, the frame member or pre-hung door assembly, as the case may be, is secured face-to-face with portion 10, as shown (FIG. 1), by additional nails (not shown) which extend through holes 46 in portion 10.

A modified form of the protector is illustrated in FIGS. 3 and 4 in which like parts are designated with the same reference numerals, primed. The FIG. 3 protector is generally similar to the FIG. 2 protector, except that portions 12 and 18 are eliminated. The FIG. 3 protector therefore does not provide an anchor but affords essentially the same protection against splitting forces as the FIG. 2 protector.

The modified protector further can be used as a template to mount a frame member or pre-hung door assembly from non-plumb support member (s) or stud (s). A typical door assembly of this type is illustrated in FIG. 4 and is generally referenced by numeral 48. The door and mounting hinges are not shown but are of conventional design.

Referring not to FIG. 4 the modified protector can be used to accomplish this object by first securing it a portion 10' to the frame number 24' by nails (not shown) extending through holes 46'. The frame member, or pre-hung door door assembly, is positioned adjacent the support members and plumbed. While maintaining the frame, member, or pre-hung door assembly, plumb, portion 14' next is secured to member 28' by nails (not shown) extending through holes 44', to mount a pre-hung door assembly, this preceedure could be followed utilizing a single protector or a protector at several locations about the door frame opening.

Although two preferred embodiments of the invention have been illustrated and described herein, variations will become apparent to one of ordinary skill in the art. Accordingly, the invention is not to be limited to the specific embodiments illustrated and described herein, and the true scope and spirit of the invention are to be determined by reference to the appended claims.

The embodiments of the invention in which an exclusive property or privelege is claimed are defined as follows:

1. In a door frame assembly having a hinged door, a door frame member having one side face thereof adjacent a free end face of said door in its closed position and a second side face on the opposite side of said door frame member, a door frame support member extending generally parallel to said second side face of said door frame member and providing structural support therefor, said door having a retractable bolt extending from the free end face thereof and engageable in an opening in said door frame member, said door frame member having a position adjacent said opening which is subject to a splitting force from said bolt during an attempt to force the door open, a door frame protector comprising; a platelike member having two spaced apart portions projecting in opposite directions in substantially parallel relation, and an intervening portion extending between said spaced apart portions in substantially perpendicular relation therewith, said intervening portion being located between said door frame support member and said second side face of said door frame member, one said spaced apart portion being secured to the door frame support member with the other said spaced apart portion in force bearing engagement with said portion of the door frame member which is subjected to a splitting force during an attempt to force the door open.

2. The apparatus of claim 1, wherein said two spaced apart portions comprise opposed oppositely projecting flange portions respectively engaged in face-to-face relation with the edge face of said door frame member adjacent the portion subjected to said splitting force and a support member face which extends normal to said one side of the door frame member.

3. The apparatus of claim 2; said door frame support member being adapted to support a wall member adjacent the other said spaced apart portion, said door frame protector including an anchor forming portion connected to said one spaced apart portion and extending therefrom in the direction of said other spaced apart portion substantially parallel to the intervening portion, said anchor forming portion being in engagement with said door frame support member and protruding from said wall member.

4. The apparatus of claim 1, wherein said intervening portion is secured to said door frame member.

5. The apparatus of claim 1, further including anchor means connected to said one spaced apart portion secured to said door frame support member, said anchor means extending beyond said support member in the direction in which said door opens and spaced from said door frame portion, said anchor means further providing means for connecting a security device.

6. In a door frame assembly having a hinged door, a door frame member having one side face thereof adjacent a free end face of said door in its closed position and a second side face on the opposite side thereof, a door frame support member extending generally parallel to said second side face of the door frame member and providing structural support therefor, said door having a retractable bolt extending from the free end face thereof and engageable in an opening in said door frame member, said door frame member having a portion adjacent said opening which is subject to a splitting force from said bolt during an attempt to force the door open, a door frame protector comprising; a plate-like member having two spaced apart portions projecting in opposite directions in substantially parallel relation, and an intervening portion extending between said spaced apart portions in substantially perpendicular relation therewith, the intervening portion being located between said door frame support member and said second side face of said door frame member, said intervening portion being secured to said door frame support member, one said spaced apart portion being secured to the door frame support member with the other said spaced apart portion in force bearing engagement with said portion of the door frame member which is subjected to a splitting force during an attempt to force the door open.

* * * * *